US007111686B2

(12) United States Patent
Den Hartogh et al.

(10) Patent No.: US 7,111,686 B2
(45) Date of Patent: Sep. 26, 2006

(54) VESSEL PROVIDED WITH A DEVICE FOR REMOVING AND/OR INSTALLING A SUB-STRUCTURE OF A DRILLING OR PRODUCTION PLATFORM

(75) Inventors: Frans Ariën Den Hartogh, BH Delft (NL); Jacob Johannes Spaan, GE Maasluis (NL)

(73) Assignee: Excalibur Engineering B.V., Delft (NL)

( * ) Notice: Subject to any disclaimer, the term of this patent is extended or adjusted under 35 U.S.C. 154(b) by 124 days.

(21) Appl. No.: 10/344,203

(22) PCT Filed: Aug. 13, 2001

(86) PCT No.: PCT/EP01/09415

§ 371 (c)(1),
(2), (4) Date: Jul. 28, 2003

(87) PCT Pub. No.: WO02/14144

PCT Pub. Date: Feb. 21, 2002

(65) Prior Publication Data

US 2004/0089453 A1 May 13, 2004

(30) Foreign Application Priority Data

Aug. 11, 2000 (NL) ..... 1015924

(51) Int. Cl.
*E21B 7/12* (2006.01)

(52) U.S. Cl. ..... 166/358; 166/353; 405/158; 114/268

(58) Field of Classification Search ..... 166/353, 166/358; 405/158, 166, 167, 168.1, 168.2, 405/168.3, 168.4; 114/268
See application file for complete search history.

(56) References Cited

U.S. PATENT DOCUMENTS 3,680,322 A * 8/1972 Nolan et al. ..... 405/166
3,860,122 A * 1/1975 Cernosek ..... 414/732
4,068,490 A * 1/1978 Jegousse ..... 405/166
4,086,777 A 5/1978 Lai
4,927,296 A 5/1990 Kaldenbach
5,421,675 A * 6/1995 Brown et al. ..... 405/170
5,464,307 A * 11/1995 Wilkins ..... 405/166
6,364,573 B1 * 4/2002 Baugh ..... 405/166
6,524,030 B1 * 2/2003 Giovannini et al. ..... 405/166
6,550,411 B1 * 4/2003 Den Hartogh et al. ..... 114/258
6,796,742 B1 * 9/2004 Roger et al. ..... 405/166

FOREIGN PATENT DOCUMENTS

NL 1012314 C 12/2000

* cited by examiner

*Primary Examiner*—Thomas A Beach
(74) *Attorney, Agent, or Firm*—The Webb Law Firm

(57) ABSTRACT

The invention relates to a vessel (1) provided with a deck (2) and with a device (3) for removing and/or installing a sub-structure (4) of a drilling or production platform, wherein said device comprises a supporting structure (5) which is capable of tilting movement in a direction transversely to an edge (6) of the deck (2), hoisting means (7) connected to said supporting structure for hoisting said sub-structure, and supporting means for supporting said sub-structure mainly during tilting movement of said supporting structure, wherein said supporting means are provided separately from the supporting structure and capable of tilting movement with respect to the edge of the deck.

13 Claims, 3 Drawing Sheets

VESSEL PROVIDED WITH A DEVICE FOR REMOVING AND/OR INSTALLING A SUB-STRUCTURE OF A DRILLING OR PRODUCTION PLATFORM

BACKGROUND OF THE INVENTION

1. Field of the Invention

The invention relates to a vessel provided with a deck and with a device for removing and/or installing a sub-structure of a drilling or production platform, wherein said device comprises a supporting structure which is capable of tilting movement in a direction transversely to an edge of the deck, hoisting means connected to said supporting structure for hoisting said sub-structure, and supporting means for supporting said sub-structure mainly during tilting movement of said supporting structure.

2. Brief Description of the Related Art

Such a vessel is disclosed in prior Dutch patent application no. 1012314 (not prepublished). The supporting structure of said vessel comprise two support beams. Each support beam is provided with supporting elements on its side remote from the vessel, which supporting elements function to support the sub-structure during tilting movement thereof. Furthermore, each support beam is fitted with hoisting means at its upper end remote from the deck. In order to provide adequate support for a sub-structure, which generally comprises downwardly diverging legs, during tilting movement thereof, said supporting elements are movable transversely to each support beam.

The object of the present invention is to provide a vessel comprising a device for removing and/or installing a sub-structure, wherein said removing/installing device has been improved.

SUMMARY OF THE INVENTION

According to the invention, the supporting means are provided separately from the supporting structure and are capable of tilting movement with respect to the edge of the deck. The points of support can be set independently of the hoisting points and be adapted to the sub-structure that is to be removed, as a result of which a more flexible removing/installing device is obtained.

Preferably, said supporting means comprise a beam. Said beam only has a supporting function, it is no longer needed in order to provide a hoisting point, so that said supporting beam can have relatively small dimensions. As a result, the bending moments exerted during tilting will be small, which makes it possible to use a light-weight and narrow beam, which enables a saving in material and thus in weight.

In a very advantageous embodiment, said supporting means comprise two beams, at least one of which is movable along the edge of the deck. This makes it possible to adapt the supporting means to the sub-structure that is to be removed: the beams are spaced closer together or further apart in dependence on the position of the legs of the sub-structure that are to be supported.

In one advantageous embodiment, said supporting structure comprises a portal, wherein the hoisting means engage the cross beam of the portal.

If the hoisting means are movable along said cross beam, a flexible removing/installing device is obtained, by means of which sub-structures of varying dimensions, for example sub-structures having four, six, eight or ten legs, can be removed.

In a very advantageous embodiment, said supporting structure consists of two portals which are connected to the edge of the deck, having a common tilting axis, and whose legs include an angle between themselves. Each portal functions to support and hoist one side of the sub-structure, towards the vessel and away from the vessel, respectively.

Preferably, the angle between the cross beams of the portals is adjustable, so that it is possible to adjust the distance between the hoisting means and the sub-structure to be removed. In the case of relatively large sub-structures, the angle between the portals can be enlarged, so that the hoisting means will be spaced further apart; in the case of relatively small sub-structures, a smaller angle between the portals will be used so as to move the hoisting means closer together.

The device for removing and/or installing a sub-structure furthermore comprises tilting means for tilting the supporting structure relative to the vessel. According to an advantageous embodiment of the invention, said tilting means comprise a winch mounted on the deck and one or more winch cables provided between said winch and said supporting structure. In addition to this, said tilting means preferably comprise a stay fitted between the deck and the supporting structure, wherein the point of engagement between said supporting structure and said stay is movable. It is known to use such a structure for telescoping the legs of a drilling platform, in order to make it possible to install said drilling platform on the seabed after towing. The advantage of such a construction is that it is possible to take up a relatively large force while using a relatively light structure.

BRIEF DESCRIPTION OF THE DRAWINGS

The invention will now be explained in more detail with reference to the appended drawings, wherein.

DETAILED DESCRIPTION OF THE PREFERRED EMBODIMENTS

Figure 1:
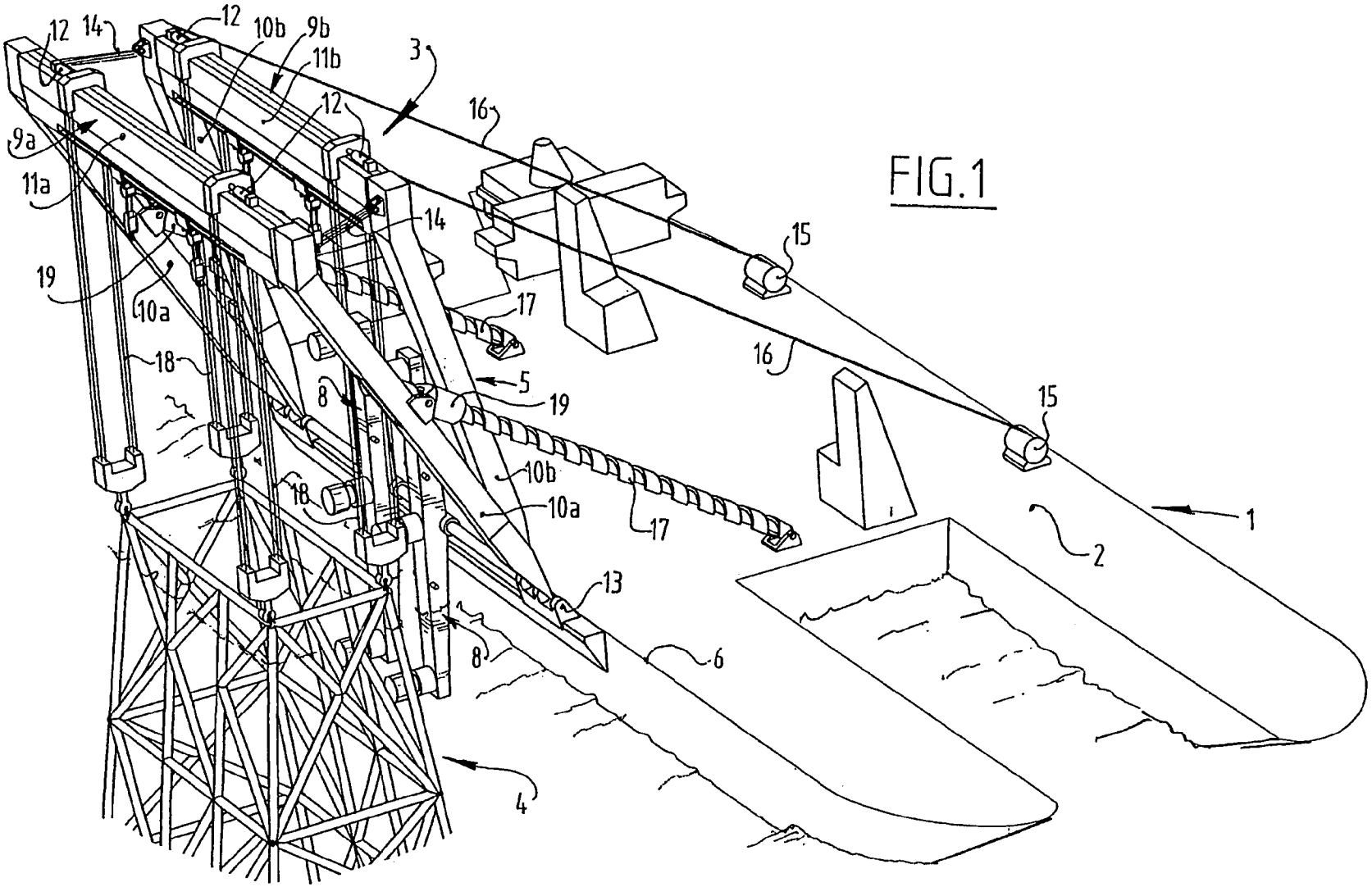
FIG. 1 is a perspective view of a vessel provided with a device for removing and/or installing a sub-structure in accordance with one preferred embodiment of the invention.

FIG. 1 is a perspective view of a vessel 1 provided with a deck 2 and a device 3 for removing and/or installing a sub-structure 4 of a drilling or production platform. Said removing/installing device 3 is positioned mainly on the starboard side of the vessel, and it comprises a supporting structure 5, which is capable of tilting movement in a direction transversely to the edge 6 of deck 2 on the starboard side of vessel 1. Removing/installing device 3 furthermore comprises hoisting means 7 for hoisting the sub-structure 4, wherein said hoisting means 7 are connected to supporting structure 5. Supporting means in the form of two beams 8, which are tiltable relative to edge 6 of deck 2, are provided separately from the supporting structure 5 for the purpose of supporting sub-structure 4 mainly during tilting movement of supporting structure 5. At least one of the beams 8 can be moved along the edge 6 of the deck 2 so as to adapt the spacing between beams 8 to the dimensions of the sub-structure 4 that is to be removed. According to another possibility, both beams 8 are movably disposed near the edge 6 of deck 2.

Supporting structure 5 comprises two portals 9*a*, 9*b*, each having two legs 10*a*, 10*b* and one cross beam 11*a*, 11*b*. Hoisting cables 18 are suspended from each cross beam 11*a*, 11*b*. Said hoisting cables 18 can be taken in and paid out by means of pulleys and winches on deck 2 or by means of cable jacks. The specific type of hoisting means is of little relevance for the invention, and consequently it will not be further described herein. To those skilled in the art it is clear what variants are possible. It should be noted, however, that the hoisting means 7 are preferably movable along cross beams 11*a*, 11*b*. Because distances of about 30–40 m need to be bridged, a pull/push cylinder 12, for example, or a rack-and-pinion drive may be used for this purpose.

The two portals 9*a*, 9*b* have a common tilting axis 13 near the edge 6 of deck 2. In addition to this, portals 9*a*, 9*b* are connected to the vessel in such a manner that their legs 10*a*, 10*b* include an angle between themselves. The angle between cross beams 11*a*, 11*b* of portals 9*a*, 9*b* can be adjusted by means of cables 14 provided between said cross beams and reels (not shown) for winding and unwinding cables 14. Said mechanism can preferably be operated by remote control.

Removing/installing device 3 is furthermore provided with tilting means for tilting portals 9*a*, 9*b* relative to vessel 1. Said tilting means consist of two winches 15 mounted on deck 2, with winch cables 16 provided between winches 15 and supporting structure 5, and two stays 17 fitted between deck 2 and supporting structure 5. In the preferred embodiment as shown in the drawings, winch cables 16 are fixed to the rear portal 9*b*, that is, the portal positioned nearest deck 2, and stays 17 engage the front portal 9*a*, that is, the portal positioned furthest away from deck 2. The point of engagement 19 between front portal 9*a* and each stay 17 is movable (compare FIGS. 1 and 2).

Since the portals 9*a*, 9*b* of supporting structure 5 have a common tilting axis 13, the cross beams 11*a*, 11*b* describe a segment of a circle during tilting. The spacing between cross. beams 11*a*, 11*b* of portals 9*a*, 9*b*, and thus the spacing between the hoisting means 7 that are present at that location, remains constant thereby.

Figure 2:
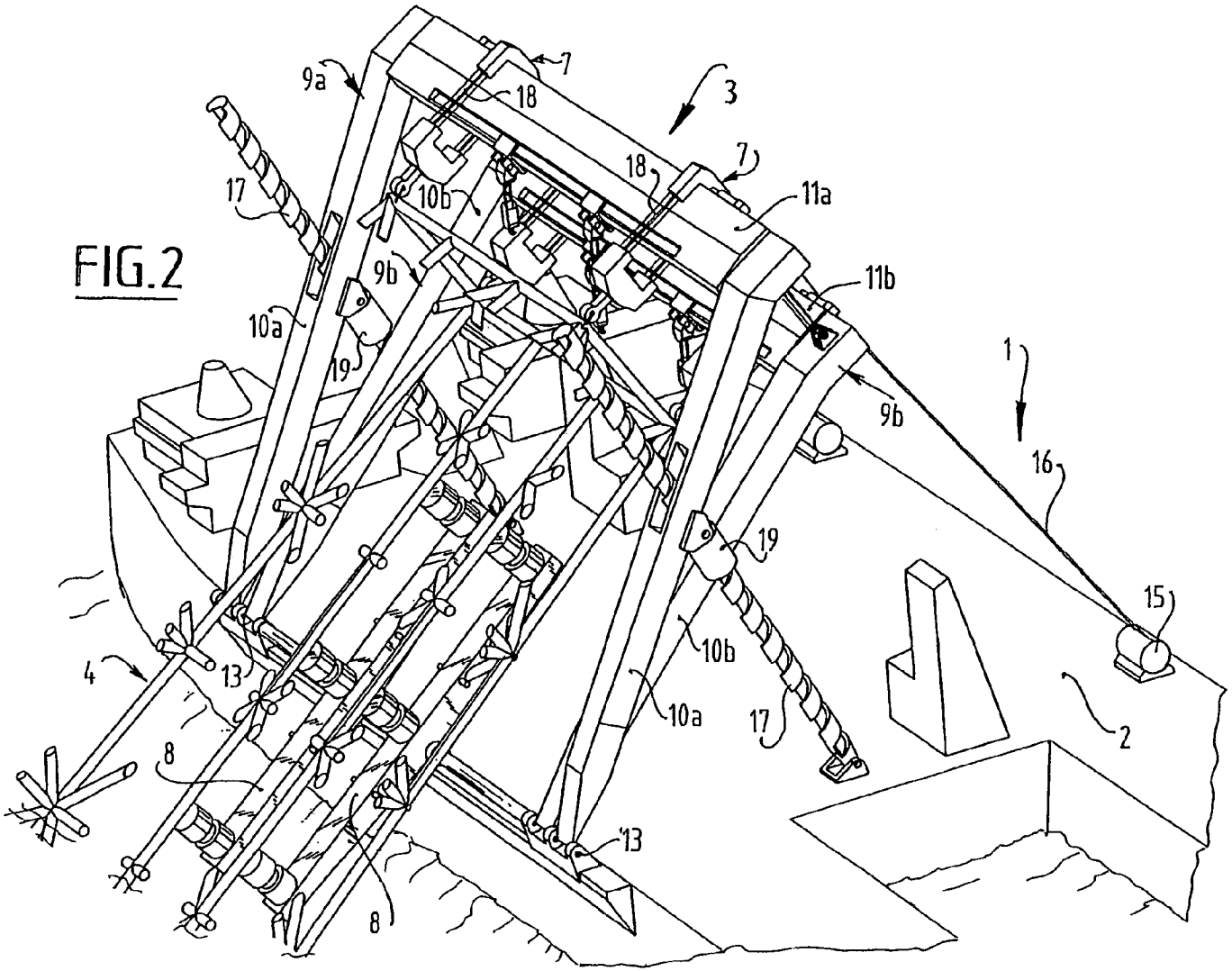
FIG. 2 shows the vessel of FIG. 1 with the removing/installing device in different working position.
Figure 3:
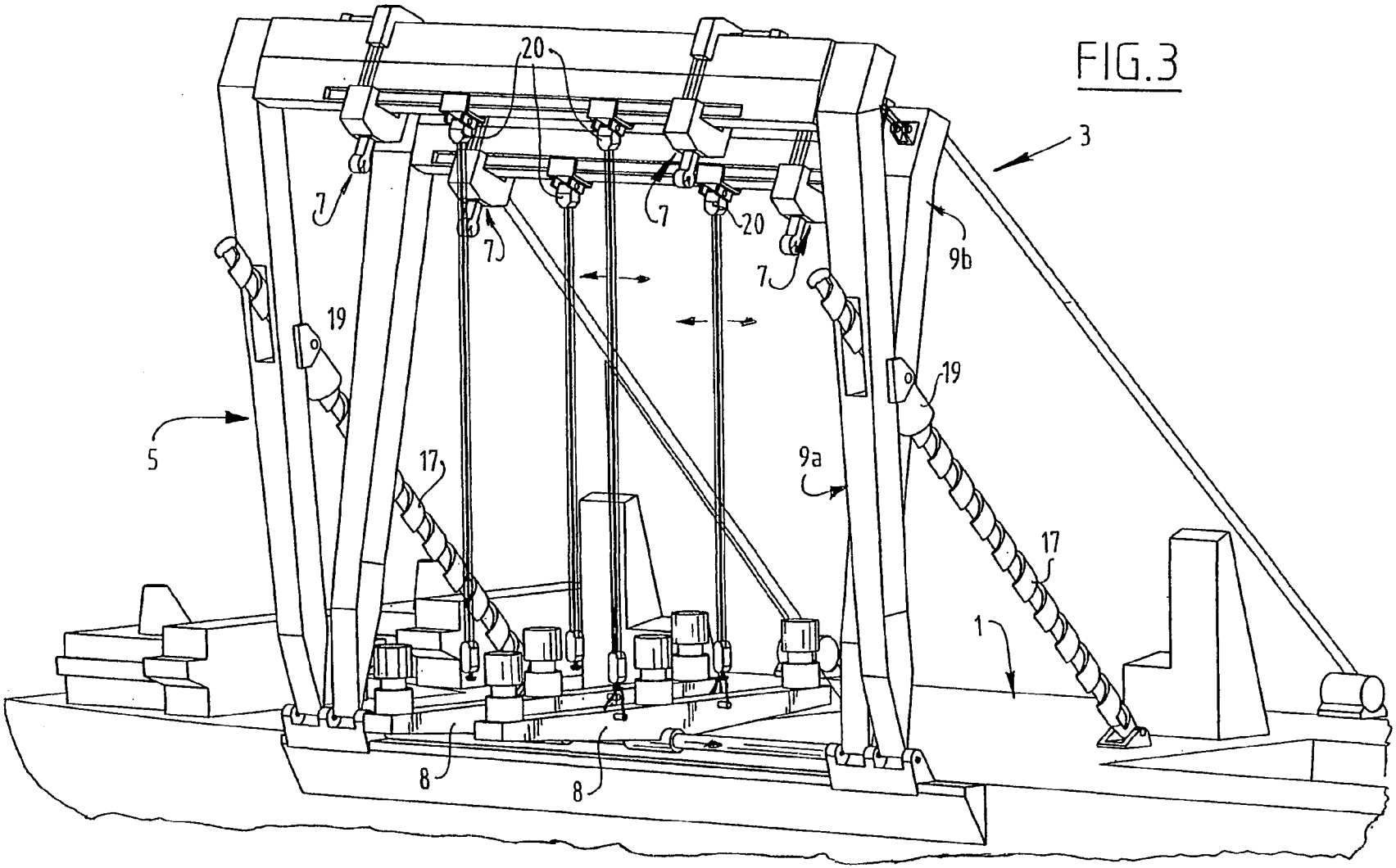
FIG. 3 is a perspective detail view of the removing/installing device of FIG. 1.

The removal of a sub-structure 4 by means of the vessel 1 according to the present invention will now be explained with reference to FIGS. 1 and 2. Starting from the working position of the removing/installing device 3 as shown in FIG. 1, the hoisting cables 18 are fixed to the upper ends of the legs of sub-structure for example by means of hydraulic clamps or crane hooks. Sub-structure 4 is lifted by hoisting means 7 in such a manner that sub-structure 4 comes into contact with beams 8. Then the supporting structure 5 is tilted about tilting axis 13 by operating the winches 15. The winch cables 16 pull at the rear portal 9*b*, which pulls the front portal 9*a* along via cables 14. During tilting, the center of gravity of sub-structure 4 will at all times be located on the side of tilting axis 13 remote from vessel 1. Upon reaching the dead center, the supporting structure 5 is prevented from tilting further by the stays 17 that support the two portals 9*a*, 9*b* (see the working position of the removing/installing device 3 in FIG. 2). The supporting beams 8 support the sub-structure 4, or rather, guide the tilting movement of sub-structure 4 immovably during tilting. The relatively small dimensions of beams 8, and thus the low bending moments, enable a relatively light-weight construction of the beams. The two supporting beams 8, or at least parts thereof, are movably mounted along edge 6 of deck 2 so as to enable adjustment of the spacing between beams 8 of the sub-structure 4 that is to be removed. Sub-structure 4 is supported near its legs during tilting, since these parts of the lattice structure of sub-structure are sufficiently strong for this purpose. In the case of a sub-structure having four legs, the outer legs will be supported, in the case of a sub-structure 4 having 8 legs (as shown in the figures), the two inner legs will be supported. In order to enable movement of beams 8, portals 9*a*, 9*b* may be fitted with auxiliary hoisting means 20, which can be moved along cross beams 11*a*, 11*b* with a load being exerted thereon. Furthermore this makes it possible to use the supporting structure 5 with auxiliary hoisting means 20 as a crane for placing constructional components of a drilling or production platform, for example, onto deck 2 or removing them therefrom. Beams 8 remain present on deck 2 thereby, and only portals 9*a*, 9*b* are tilted in order to move the constructional component to be removed from outside vessel 1 between the legs 10*a*, 11*b* of portals 9*a*, 9*b* and place it onto deck 2, or vice versa. Since the constructional component that is to be removed does not tilt along with the portals, it is necessary in that case to adjust the angle between portals 9*a*, 9*b* during tilting, in such a manner that the spacing in horizontal direction between the auxiliary hoisting means 20 on the two cross beams 11*a*, 11*b* remains the same.

Finally it is noted that the sub-structure 4 can be moved further onto the deck 2 after tilting, for example by means of the winches.

Although the invention has been explained by means of a description of the removal of a sub-structure, the vessel can also be used for installing a sub-structure, of course.

The invention claimed is:

1. A vessel provided with a deck and with a device for removing and/or installing a sub-structure of a drilling or production platform, wherein said device comprises a supporting structure which is capable of tiling movement around a tilting axis in a direction transversely to an edge of the deck, hoisting means connected to said supporting structure for hoisting said sub-structure, and supporting means for directly supporting said sub-structure mainly during tilting movement of said supporting structure with the center of gravity of the sub-structure located on a side of the tilting axis remote from the vessel, wherein said supporting means are provided separately from the supporting structure and are capable of tiling movement with respect to the edge of the deck.

2. The vessel according to claim 1, wherein said supporting means comprise a beam.

3. The vessel according to claim 1, wherein said supporting means comprise two beams, at least one of which is movable along the edge of the deck.

4. The vessel according to claim 1, wherein said supporting structure comprises a portal, wherein the hoisting means engage the cross beam of the portal.

5. The vessel according to claim 4, wherein said hoisting means are movable along said cross beam.

6. The vessel according to claim 1, wherein said supporting structure consists of two portals which are connected to the edge of the deck, having a common tilting axis, and whose legs include an angle between themselves.

7. The vessel according to claim 6, wherein the angle between the cross beams of said portals is adjustable.

8. The vessel according to claim 1, wherein said device furthermore comprises tilting means for tilting said supporting structure relative to the vessel.

9. The vessel according to claim 8, wherein said tiling means comprise a winch mounted on the deck and one or more winch cables provided between said winch and said supporting structure.

10. The vessel according to claim 9, wherein said tilting means furthermore comprise a stay fitted between the deck and the supporting structure, wherein the point of engagement between said supporting structure and said stay is movable.

11. The vessel according to claim 1, wherein said supporting structure and said supporting means is located on an afterdeck of the vessel.

12. A vessel provided with a deck and with a device for removing and/or installing a sub-structure of a drilling or production platform, wherein said device comprises a supporting structure which is capable of tiling movement around a tilting axis in a direction transversely to an edge of the deck, hoisting means connected to said supporting structure for hoisting said sub-structure, and supporting means for directly supporting said sub-structure mainly during tilting movement of said supporting structure with the center of gravity of the sub-structure located on the side of the tilting axis remote from the vessel, wherein said supporting means are provided separately from the supporting structure and are capable of tiling movement with respect to the edge of the deck, and wherein said supporting structure and said supporting means have a common axis of tilt.

13. A vessel provided with a deck and with a device for removing and/or installing a sub-structure of a drilling or production platform, wherein said device comprises a supporting structure which is capable of tiling movement around a tilting axis in a direction transversely to an edge of the deck, hoisting means connected to said supporting structure for hoisting said sub-structure, and supporting means for directly supporting said sub-structure mainly during tilting movement of said supporting structure with the center of gravity of the sub-structure located on a side of the tilting axis remote from the vessel, wherein said supporting means are provided separately from the supporting structure and are capable of tiling movement with respect to the edge of the deck, and wherein the orientation of said supporting means with respect to the sub-structure is constant during tilting movement of said supporting structure.

* * * * *

UNITED STATES PATENT AND TRADEMARK OFFICE

CERTIFICATE OF CORRECTION

PATENT NO. : 7,111,686 B2
APPLICATION NO. : 10/344203
DATED : September 26, 2006
INVENTOR(S) : Den Hartogh et al.

It is certified that error appears in the above-identified patent and that said Letters Patent is hereby corrected as shown below:

Title Page, [57] ABSTRACT, delete the current Abstract and replace it with the following Abstract:

-- ABSTRACT OF THE DISCLOSURE

The invention relates to a vessel provided with a deck and with a device for removing and/or installing a sub-structure of a drilling or production platform, wherein the device has a supporting structure which is capable of tilting movement in a direction transversely to an edge of the deck, a hoist connected to the supporting structure for hoisting the sub-structure, and a support for supporting said sub-structure mainly during tilting movement of the supporting structure, wherein the support is provided separately from the supporting structure and capable of tilting movement with respect to the edge of the deck. --

Column 4, Line 34, Claim 1, “tiling movement” should read -- tilting movement --

Column 4, Line 43, Claim 1, “tiling movement” should read -- tilting movement --

Column 4, Line 64, Claim 9, “tiling means” should read -- tilting means --

Column 5, Line 12, Claim 12, “tiling movement” should read -- tilting movement --

Column 5, Line 21, Claim 12, “tiling movement” should read -- tilting movement --

UNITED STATES PATENT AND TRADEMARK OFFICE

CERTIFICATE OF CORRECTION

PATENT NO. : 7,111,686 B2
APPLICATION NO. : 10/344203
DATED : September 26, 2006
INVENTOR(S) : Den Hartogh et al.

It is certified that error appears in the above-identified patent and that said Letters Patent is hereby corrected as shown below:

Column 6, Line 7, Claim 13, "tiling movement" should read -- tilting movement --

Column 6, Line 16, Claim 13, "tiling movement" should read -- tilting movement --

Signed and Sealed this

Second Day of September, 2008

JON W. DUDAS
*Director of the United States Patent and Trademark Office*